US005387573A

United States Patent [19]

Oldfield et al.

[11] Patent Number: 5,387,573

[45] Date of Patent: Feb. 7, 1995

[54] THERMAL DYE TRANSFER DYE-DONOR ELEMENT WITH TRANSFERABLE PROTECTION OVERCOAT CONTAINING PARTICLES

[75] Inventors: Mary Catherine S. Oldfield, Rochester; Kin K. Lum, Webster, both of N.Y.

[73] Assignee: Eastman Kodak Company, Rochester, N.Y.

[21] Appl. No.: 163,105

[22] Filed: Dec. 7, 1993

[51] Int. Cl.[6] ..... B41M 5/035; B41M 5/38

[52] U.S. Cl. ..... 503/227; 428/195; 428/206; 428/323; 428/336; 428/500; 428/913; 428/914

[58] Field of Search ..... 8/471; 428/195, 206, 428/323, 327, 500, 520, 522, 913, 914, 336; 503/227

[56] References Cited

U.S. PATENT DOCUMENTS

| | | | |
|---|---|---|---|
| 4,666,320 | 5/1987 | Kobayashi et al. | 400/241.1 |
| 4,738,555 | 4/1988 | Nagashima | 400/240 |
| 5,244,234 | 9/1993 | Oshima et al. | 283/109 |

FOREIGN PATENT DOCUMENTS

| | | | |
|---|---|---|---|
| 4-52223 | 9/1983 | Japan | 503/227 |

*Primary Examiner*—B. Hamilton Hess
*Attorney, Agent, or Firm*—Harold E. Cole

[57] ABSTRACT

A dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer contains particles in an amount of up to about 75% of the thickness of said transferable protection layer.

20 Claims, No Drawings

THERMAL DYE TRANSFER DYE-DONOR ELEMENT WITH TRANSFERABLE PROTECTION OVERCOAT CONTAINING PARTICLES

This invention relates to a dye-donor element for thermal dye transfer, and more particularly to the use of particles in a transferable protection overcoat in the element for transfer to a thermal print.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

U.S. Pat. Nos. 4,738,555 and 4,666,320 and JP 4-52223 disclose a dye-donor element for thermal dye transfer wherein a transparent ink region is also present on the element which is used to form a protective layer over the printed image. U.S. Pat. No. 5,332,713 by the same inventors, and entitled "Thermal Dye Transfer Dye-Donor Element Containing Transferable Protection Overcoat", the disclosure of which is hereby incorporated by reference, also discloses various polymeric materials such as poly(vinyl acetal) for the same purpose.

However, there is a problem with the above-described materials used in protective overcoats, especially when the overcoat is less than about 1 μm, in that an iridescent pattern is produced which degrades the appearance of an image when it is viewed in reflected light. Elimination of this iridescence is highly desirable for enhanced print quality.

It is an object of this invention to provide a protective coat for a thermal dye transfer image which can be applied by the thermal print head, which avoids undesirable retransfer of dye to adjacent surfaces, and which reduces the iridescent pattern which is produced when the image is viewed in reflected light.

These and other objects are achieved in accordance with this invention which relates to a dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer contains particles in an amount of up to about 75% of the thickness of the transferable protection layer. In general, good results have been obtained when the transferable protection layer has a thickness of less than 1 μm.

In a preferred embodiment of the invention, the dye-donor element is a multicolor element comprising repeating color patches of yellow, magenta and cyan image dyes, respectively, dispersed in a binder, and a patch containing the protection layer.

In another embodiment of the invention, the protection layer is the only layer on the donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-white element and comprises repeating units of two areas, the first area comprising a layer of a mixture of image dyes dispersed in a binder to produce a neutral color, and the second area comprising the protection layer.

In yet still another preferred embodiment of the invention, the protection layer comprises a polymer such as poly(vinyl acetal), as disclosed in U.S. Pat. No. 5,332,713.

In another preferred embodiment of the invention, the particles are organic particles such as polymers like phenolic resins, melamine resins, urethane resins, epoxy resins, silicone resins, urea resins, diallyl phthalate resins, alkyd resins, acetal resins, acrylic resins, methacrylic resins, polyester resins, cellulose resins, starch and derivatives thereof, poly(vinyl chloride), poly(vinylidene chloride), chlorinated polyethylene, fluorocarbon resins, polyethylene, polypropylene, polystyrene, polyvinylbenzene, poly(vinyl acetal), polyamides, poly(vinyl alcohol), polycarbonates, polysulfones, polyether sulfones, polyphenylene oxide, polyphenylene sulfide, polyether ketones, polyaminobismaleimide, polyacrylates, poly(ethylene terephthalate), polyimides, polyamide-amides, polyacrylonitrile, etc.

In another preferred embodiment of the invention, the particles are inorganic particles such as metals, e.g., aluminum, silicon, germanium, tin, copper, zinc, silver, iron, cobalt, nickel, chromium, etc.; metal oxides, e.g., alumina, beryllium oxide, magnesium oxide, cuprous oxide, zinc oxide, indium oxide, tin oxide, titanium oxide, silicon oxide, iron oxide, cobalt oxide, nickel oxide, maganese oxide, tantalum oxide, vanadium oxide, tungsten oxide, molybdenum oxide, etc.; metal sulfides, e.g., copper sulfide, zinc sulfide, tin sulfide, molybdenum sulfide, etc.; minerals, e.g., magnesia minerals, lime minerals, strontium minerals, barium minerals, zirconium minerals, titanium minerals, tin minerals, phosphorus minerals, aluminum minerals such as agalmatolite, kaolin, clay, silicon minerals such as quartz, mica, talc, zeolite, diatomaceous earth, etc.; inorganic salts such as carbonates or sulfates of alkaline earth metals such as magnesium carbonate, calcium carbonate, strontium carbonate, barium carbonate, magnesium sulfate, calcium sulfate, strontium sulfate, barium sulfate and other metal sulfates; etc.

Specific particles useful in the invention include the following:

1) divinylbenzene beads 4 μm
2) fumed silica (Cabosil® L-90, Cabot Corp.) BET
3) (Brunauer Emmett Teller) Surface Area of 100 + or − 15 $m^2/g$
3) hexamethyl-disilazane treated fumed silica (Cabosil® TS-530, Cabot Corp.) BET Surface Area of 200 + or − 40 $m^2/g$
4) dimethyl-dichlorosilane-treated fumed silica (Cabosil® TS-610, Cabot Corp.) BET Surface Area of 120 + or − 20 $m^2/g$
5) dimethyl silicon treated fumed silica (Cabosil® TS-720, Cabot Corp.) BET Surface Area of 100 + or − 20 $m^2/g$
6) amorphous silica, 1.5 μm, Zeothix® 177 (Hueber Corp.)
7) amorphous silica, 2.3 μm, Zeothix® 95 (Hueber Corp.)
8) 70 mole % styrene/30 mole % divinylbenzene, 2.0 μm
9) 90 mole % styrene/10 mole % divinylbenzene, 8.3 μm
10) 90 mole % styrene/10 mole % divinylbenzene, 12.3 μm
11) 95 mole % styrene/5 mole % divinylbenzene, 4.0 μm
12) 95 mole % styrene/5 mole % divinylbenzene, 6.0 μm
13) 95 mole % styrene/5 mole % divinylbenzene, 12.0 μm
14) 95 mole % styrene/5 mole % divinylbenzene, 16.0 μm
15) 95 mole % styrene/5 mole % divinylbenzene, 20.0 μm
16) divinylbenzene, 7.7 μm
17) divinylbenzene, 9.5 μm
18) divinylbenzene, 4.0 μm
19) Tospearl® 120 (Toshia Silicone Co.) silicone methyl sesquioxane 2.0 μm
20) Tospearl® 145 (Toshia Silicone Co.) silicone methyl sesquioxane 4.5 μm
21) Tospearl® 240 (Toshia Silicone Co.) silicone amorphous sesquioxane 4.0 μm
22) Aerosil® R972 (Degussa Corp.) hydrophobic fumed silica 16 nm
23) 67 mole % isobutyl methacrylate/30 mole % 2-ethylhexyl methacrylate/3 mole % divinylbenzene microgel While any size particle can be added in sufficient quantity to reduce iridescence, particle sizes greater than or equal to approximately 8 μm may produce a rough surface and be noticeable to the naked eye. Particles having a particle size equal to or less than 8 μm are therefore preferred. The particles also help the protective layer separate cleanly from the dye-donor element, reducing ragged edges which sometimes are obtained during the separtion step.

The present invention provides a protective overcoat layer applied to a thermal print by uniform application of heat using a thermal head. After transfer to the thermal print, the protective layer provides superior protection against image deterioration due to exposure to light, common chemicals, such as grease and oil from fingerprints, and plasticizers from film album pages or sleeves made of poly(vinyl chloride). The protection layer is generally applied in a concentration of at least about 0.05 $g/m^2$.

In use, yellow, magenta and cyan dyes are thermally transferred from a dye-donor element to form an image on the dye-receiving sheet. The thermal head is then used to transfer a clear protective layer, from another clear patch on the dye-donor element or from a separate donor element, onto the imaged receiving sheet by uniform application of heat. The clear protective layer adheres to the print and is released from the donor support in the area where heat is applied.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

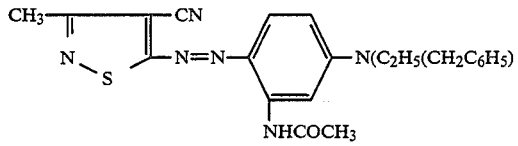
(magenta)

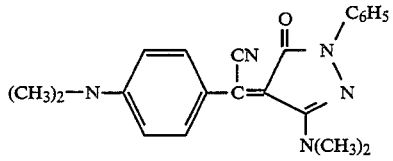
(magenta)

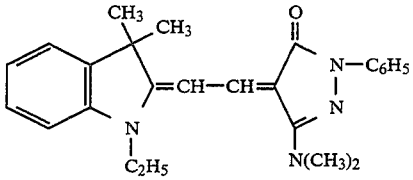
(yellow)

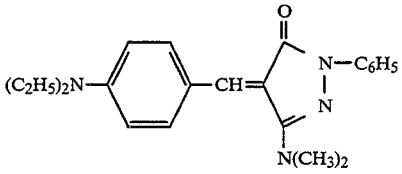

-continued
(yellow)

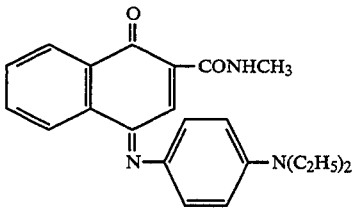

cyan

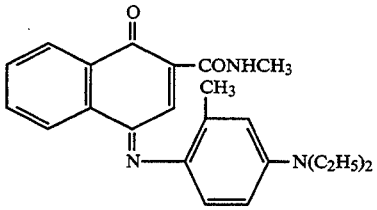

cyan or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, polycaprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and
(b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following examples are provided to illustrate the invention.

EXAMPLE 1

Protective layer donor elements were prepared by coating on a 6 μm poly(ethylene terephthalate) support:

1) a subbing layer of titanium alkoxide (DuPont Tyzor TBT) ® (0.12 g/m$^2$) from a n-propyl acetate and n-butyl alcohol solvent mixture, and
2) a slipping layer containing an aminopropyl-dimethyl-terminated polydimethylsiloxane, PS513 ® (Petrarch Systems, Inc.) (0.01 g/m$^2$), a cellulose acetate propionate binder (0.54 g/m$^2$), p-toluenesulfonic acid (0.0003 g/m$^2$), candellila wax (0.02 g/m$^2$), a copolymer of poly(propylene oxide) and poly(methyl octyl siloxane), BYK320-S732 ® (98% in Stoddard solvent) (Byk Chemie), (0.005 g/m$^2$), coated from a solvent mixture of toluene, methanol and cyctopentanone (66.5/28.5/5).

The other side of the donor element was coated with a solution of poly(vinyl acetal) (0.32 g/m$^2$) (Sekisui KS-1) in a 75/25 solvent mixture of 3-pentanone-/methanol (some at 100% 2-butanone as noted in the Table) and the particles as listed in Table 1.

An automated sample coater was used to deliver the solution through a hopper at 16.2 cc/m$^2$ (some at 10.8 cc/m$^2$ as noted in the Table) at a coating speed of 4.26 cm/sec. The automated sample coater had a temperature-controlled coating block with a vacuum hold down for the support. The temperature of this coating block was maintained at 29° C. for all coating solutions, except for Control 1 which was dried at 49° C.

The dye-receiving element was prepared by coating a subbing layer of 0.11 g/m$^2$ Dow Z-6020 in 99% ethanol/1% water onto a microvoided polypropylene support with a poly(vinyl alcohol)/poly(ethylene oxide) antistatic backing layer. The following receiving and overcoat layers were then simultaneously coated over the subbing layer.

Receiving Layer

- 1.78 g/m$^2$ of KL3-1013 polyether-modified bisphenol A polycarbonate identified below
- 1.46 g/m$^2$ Lexan ® 141-112 bisphenol A polycarbonate (General Electrical Co.)
- 0.32 g/m$^2$ diphenyl phthalate
- 0.32 g/m$^2$ dibutyl phthalate
- 0.01 g/m$^2$ FC-431 ® fluorocarbon surfactant (3M Corp.)

Solvent: methylene chloride

Receiver Overcoat:

- 0.22 g/m$^2$ bisphenol A polycarbonate containing 49% diethylene glycol and 1% polydimethyl-siloxane
- 0.008 g/m$^2$ DC-510 silicone surfactant (Dow-Corning)
- 0.02 g/m$^2$ FC-431 ® fluorocarbon surfactant (3M Corp.)

Solvent: methylene chloride

Polycarbonates used:

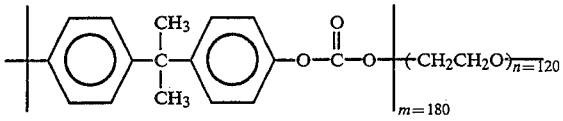

KL3-1013, block copolymer of polyether glycol and bisphenol A polycarbonate (Bayer AG)

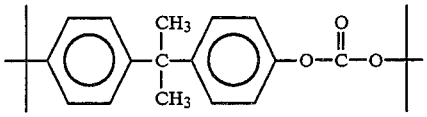

Bisphenol A polycarbonate Lexan 141 ® (General Electric Company)

The coated side of the donor element described above, in a strip about 10×14 cm in area, was placed in contact with the dye image-receiving layer of a dye-receiver element, as described above, of the same area. Non-imaged receiver was laminated to emphasize the iridescence or lack of iridescence. The assemblage was clamped to a stepper-motor driving a 53 mm diameter rubber roller, and a TDK Thermal Head (No. L-231) (thermostatted at 30° C.) was pressed with a force of 24.5 Newtons against the dye-donor element side of the assemblage pushing it against the rubber roller. (The TDK L-231 thermal print head has 512 independently addressable heaters with a resolution of 5.4 dots/mm and an active printing width of 95 mm, of average heater resistance 494 ohms.)

The imaging electronics were activated and the assemblage was drawn between the printing head and roller at 17.7 mm/sec. Coincidentally, the resistive elements in the thermal print head were pulsed on for 70 μsec every 130 μsec. Printing maximum density requires 75 pulses "on" time per printed line of 10.5 μsec. The voltage supplied was 16.1 volts resulting in an instantaneous peak power of approximately 0.525 Watts/dot and the maximum total energy required to print 2.3 Dmax was 2.76 mjoules/dot. The image was printed with a 1:1 aspect ratio. The laminate donor was heated uniformly at an energy level equivalent to printing maximum dye density (2.76 mJ/dot) with the thermal head to permanently adhere the polymeric film to the print. At the end of the heating cycle, the donor support was peeled away leaving the polymeric film adhered to the print. The appearance of the laminate samples was observed and evaluated for the presence of an iridescent pattern. The results are shown in the following Table.

TABLE

| Particles Added ($g/m^2$) | Observed Iridescence |
|---|---|
| None (Control-1) | Yes |
| None (Control-2)* | Yes |
| 1* (0.03) | No |
| 2 (0.01) | Slight |
| 2 (0.03) | No |
| 3 (0.03) | v. slight |
| 4 (0.03) | Slight |
| 5 (0.01) | v. slight |
| 5 (0.03) | No |
| 6 (0.01) | v. slight |
| 6 (0.03) | No |
| 7 (0.01) | Slight |
| 7 (0.03) | No |
| 8 (0.03) | v. slight |
| 9 (0.03) | slight |
| 10 (0.03) | slight |
| 11 (0.03) | No |
| 12 (0.03) | v. slight |
| 13 (0.03) | slight |
| 14 (0.03) | slight |
| 15 (0.16) | slight |
| 16 (0.03) | slight |
| 17 (0.03) | slight |
| 18 (0.03)** | No |
| 19 (0.03)** | Slight |
| 20 (0.09)** | No |
| 21 (0.03)** | Slight |
| 22 (0.03) | No |
| 22 (0.08) | No |
| 23 (0.03) | No |
| 23 (0.08) | No |

*polymer was poly(methyl methacrylate)
**2-butanone coating solvent at 10.8 $cc/m^2$ The above results show that the addition of organic, inorganic or microgel particles to the protective layer in sufficient quantities facilitates the scattering of light and reduces or eliminates the objectionable iridescent pattern on the laminated print.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon at least one dye layer area comprising an image dye in a binder and another area comprising a transferable protection layer, said transferable protection layer area being approximately equal in size to said dye layer area and being less than about 1 μm thick, wherein said transferable protection layer contains particles in an amount of up to about 75% of the amount of said transferable protection layer.

2. The element of claim 1 wherein said particles are organic.

3. The element of claim 1 wherein said particles are inorganic.

4. The element of claim 1 wherein said particles have a particle size of 8 μm or less.

5. The element of claim 1 wherein said transferable protection layer comprises a polymer.

6. The element of claim 5 wherein said polymer comprises poly(vinyl acetal).

7. The element of claim 1 wherein said dye-donor element is a multicolor element comprising repeating color patches of yellow, magenta and cyan image dyes, respectively, dispersed in a binder, and a patch containing said protection layer.

8. A process of forming a protection layer on top of a thermal dye transfer image comprising:

(a) imagewise-heating a dye-donor element comprising a support having thereon at least one dye layer area comprising an image dye in a binder, said dye-donor being in contact with a dye-receiving element, thereby transferring a dye image to said dye-receiving element to form said dye transfer image; and (b) thermally transferring a protection layer less than about 1 μm thick on top of said transferred dye image, said protection layer being applied from another area of said dye-donor element, said transferable protection layer area being approximately equal in size to said dye layer area, said transferable protection layer containing particles in an amount of up to about 75% of the amount of said transferable protection layer in order to reduce iridescence of the protection layer located over the transferred image.

9. The process of claim 8 wherein said particles are organic.

10. The process of claim 8 wherein said particles are inorganic.

11. The process of claim 8 wherein said particles have a particle size of 8 μm or less.

12. The process of claim 8 wherein said transferable protection layer comprises a polymer.

13. The process of claim 12 wherein said polymer comprises poly(vinyl acetal).

14. The process of claim 8 wherein said dye-donor element is a multicolor element comprising repeating color patches of yellow, magenta and cyan image dyes, respectively, dispersed in a binder, and a patch containing said protection layer.

15. A thermal dye transfer assemblage comprising (a) a dye-donor element for thermal dye transfer comprising a support having thereon at least one dye layer area comprising an image dye in a binder and another area comprising a transferable protection layer, said transferable protection layer area being approximately equal in size to said dye layer area and being less than about 1 μm thick, wherein said transferable protection layer contains particles in an amount of up to about 75% of the amount of said transferable protection layer; and (b) a dye receiving element comprising a support having thereon a dye image-receiving layer, said dye-receiving element being in a superposed relationship with said dye-donor element so that said dye layer is in contact with said dye image-receiving layer.

16. The assemblage of claim 15 wherein said particles are organic.

17. The assemblage of claim 15 wherein said particles are inorganic.

18. The assemblage of claim 15 wherein said particles have a particle size of 8 μm or less.

19. The assemblage of claim 15 wherein said transferable protection layer comprises a polymer.

20. The assemblage of claim 15 wherein said dye-donor element is a multicolor element comprising repeating color patches of yellow, magenta and cyan image dyes, respectively, dispersed in a binder, and a patch containing said protection layer.

* * * * *